US005970931A

United States Patent [19]

Kawarabata

[11] Patent Number: 5,970,931

[45] Date of Patent: Oct. 26, 1999

[54] CAMSHAFT DRIVING MECHANISM

[75] Inventor: Takanori Kawarabata, Tokyo, Japan

[73] Assignee: Fuji Jukogyo Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/905,120

[22] Filed: Aug. 1, 1997

[30] Foreign Application Priority Data

Aug. 22, 1996 [JP] Japan ..... 8-221616

[51] Int. Cl.[6] ..... F01L 1/02

[52] U.S. Cl. ..... 123/90.31; 123/54.4; 123/55.2

[58] Field of Search ..... 123/90.27, 90.31, 123/54.4, 54.5, 54.6, 54.7, 54.8, 55.2, 195 HC, 195 AC

[56] References Cited

U.S. PATENT DOCUMENTS

| | | | |
|---|---|---|---|
| 3,673,990 | 7/1972 | Alfieri | 123/90.31 |
| 4,643,143 | 2/1987 | Uchiyama et al. | 123/90.31 |
| 4,936,265 | 6/1990 | Speier | 123/90.31 |
| 5,010,855 | 4/1991 | Ogami et al. | 123/90.31 |
| 5,010,859 | 4/1991 | Ogami et al. | 123/90.31 |
| 5,014,655 | 5/1991 | Ampferer | 123/90.31 |
| 5,058,458 | 10/1991 | Odai | 123/90.31 |
| 5,231,961 | 8/1993 | Shimada et al. | 123/90.27 |
| 5,295,459 | 3/1994 | Suzuki et al. | 123/90.31 |
| 5,400,748 | 3/1995 | Batzill et al. | 123/90.31 |

FOREIGN PATENT DOCUMENTS

| | | | |
|---|---|---|---|
| 624717 | 11/1994 | European Pat. Off. | 123/90.31 |
| 4200509 | 7/1993 | Germany | 123/90.31 |
| 2-211307 | 8/1990 | Japan . | |
| 3-81509 | 4/1991 | Japan . | |
| 5-156903 | 6/1993 | Japan . | |

*Primary Examiner*—Weilun Lo
*Attorney, Agent, or Firm*—Smith, Gambrell & Russell, LLP

[57] ABSTRACT

In an overhead cam type internal combustion engine having a cylinder block extended at an angle to either side of a crankshaft, a first cylinder head is mounted on one side of the cylinder block and a second cylinder head is mounted on the other side of the cylinder block. Each of the first and second cylinder heads includes at least one camshaft for opening and closing intake and exhaust valves. A camshaft driving mechanism comprises a first driving force transmitting means interlocked with the camshaft of the first cylinder head and the crankshaft so as to drive the camshaft thereof, an idler shaft provided at such a position as to equalize the elongation of the first driving force transmitting means with that of the second driving force transmitting means and driven by the first driving force transmitting means, and a second driving force transmitting means interlocked with the idler shaft and the camshaft of the second cylinder head so as to drive the camshaft thereof, whereby the length of the driving force transmitting means can be shortened and the elongation thereof can be reduced. Further, the rotational angular deviation between the camshafts on both sides can be minimized.

7 Claims, 6 Drawing Sheets

CAMSHAFT DRIVING MECHANISM

BACKGROUND OF THE INVENTION

1. Field of the Invention

The present invention relates to a camshaft driving mechanism for an internal combustion engine, in particular, to a camshaft driving mechanism for an overhead camshaft V-type internal combustion engine whose left and right banks of a cylinder block are set at an angle to each other, including a horizontally opposed engine whose left and right banks are arranged 180°.

2. Prior Arts

With respect to a camshaft driving mechanism for a V-type engine or a horizontally opposed engine of which cylinder blocks are set to each other at an angle, since camshafts supported with the cylinder head is rotated by the driving force of the crank shaft so as to open and close the intake and exhaust valves at a specified timing, so many driving mechanisms for rotating the camshafts have ever been proposed.

Japanese patent application laid-open No. Toku-Kai-Hei 2-211307, as shown in FIG. 7, discloses a camshaft driving mechanism for a DOHC engine comprising a crankshaft 100, intermediate shafts 114, 116 provided at each of left and right banks 114, 116 respectively, camshafts 108, a first driving chain 102 which interlocks the crankshaft 100 with the intermediate shafts 114, 116, and second driving chains 118, 120 provided at each of left and right banks 110, 112 respectively which interlocks the intermediate shafts 114, 116 with the cam shafts 108, so as to drive these camshafts with the crankshaft through the intermediate shafts.

Further, Japanese patent application laid-open No. Toku-Kai-Hei 5-156903, as shown in FIG. 8, also discloses a camshaft driving mechanism for a DOH internal combustion engine comprising a crankshaft 100, a camshaft 108 of a right cylinder head 106, an intermediate shaft 114 provided on the left bank side, a first driving chain 102 wound around the crankshaft 100, the camshaft 108 of the right cylinder head 106 and the intermediate shaft 114 so as to drive the camshafts on the right bank side, camshafts 108 of the left bank side and a second driving chain 122 wound around the intermediate shaft 114 and the camshafts 108 on the left bank side so as to drive the camshafts on the left bank side.

However, as shown in the forgoing examples of prior arts, in case of employing chains as a means for transmitting driving force, commonly there is a problem of lengthwise elongation in chains due to wearing, its own elasticity or thermal expansion.

In the former prior art disclosed in Toku-Kai-Hei 2-211307, when the first driving chain 102 is elongated, the rotational angular deviation of the camshaft 108 on the right bank side becomes larger than that of the camshaft 108 on the left bank side with respect to the rotational angle of the crankshaft 100, because when viewing from the tight side of the driving chain the length of the chain between the crankshaft 100 and the intermediate shaft 116 is larger than that between the crankshaft 100 and the intermediate shaft 114.

Similarly, in the latter prior art in Toku-Kai-Hei 5-156903, when the first chain 102 is elongated, the rotational angular deviation of the camshaft 108 on the right bank side becomes larger than that of the camshaft 108 on the left bank side with respect to the rotational angle of the crankshaft 100, because the length (mn+qr+st) on the tight side of the driving chain between the crankshaft 100 and the camshaft 108 on the right bank side is larger than the length (mn+op) on the tight side of the driving chain between the crankshaft 100 and the camshaft 108 on the left bank side.

This deviation in the rotational angle of the camshaft between the left and right banks 110, 112 produces a difference in the valve timing between the left and right banks, this leading to irregular combustion in cylinders or other unfavorable phenomenon.

Further, generally, in the internal combustion engine, accessories such as alternator (generator), water pump and oil pump are driven by a V-belt interconnected with at least one pulley. In most cases, the pulley (crank pulley) is connected with the crank shaft. Generally, the V-belt driving system must be incorporated separately from the chain drive system because lubrication is needed for all components such as chains and sprockets. Therefore, as shown in FIG. 9, a crank pulley 124 for driving accessories is disposed outside of a chain cover 128. Further, the first driving chain 102 must be arranged on a different plane from the second chain 122, therefore the engine 99 requires a substantial lengthwise space for accommodating these driving chains. Since a further lengthwise space is needed for the crank pulley 124, the overall lengthwise size of the engine inevitably becomes large in the prior arts.

SUMMARY OF THE INVENTION

In view of the foregoing problems, it is an object of the present invention to provide a camshaft driving mechanism capable of reducing a rotational angular deviation of the camshafts with respect to the crankshaft and saving a lengthwise size of the engine.

A camshaft driving mechanism for an overhead cam type internal combustion engine having a crankshaft, a cylinder block extended at an angle including 180° to either side of the crankshaft, a first cylinder head mounted on one side of the cylinder block and a second cylinder head mounted on the other side of the cylinder block, each of the first and second cylinder heads including at least one camshaft for opening and closing intake and exhaust valves, comprises:

first driving force transmitting means for transmitting a rotational force of the crankshaft to the camshaft of the first cylinder head;

an idler shaft provided in the cylinder block between the first and second cylinder heads for receiving the rotational force from the crankshaft; and second driving force transmitting means for receiving the rotational force from the idler shaft and transmitting this rotational force to the camshaft of the second cylinder head.

DESCRIPTION OF THE DRAWINGS

These and other objects and features of the present invention will become more apparent by referring to the accompanying drawings which illustrate specific embodiments of the invention.

DETAILED DESCRIPTION OF PREFERRED EMBODIMENTS

Figure 1:
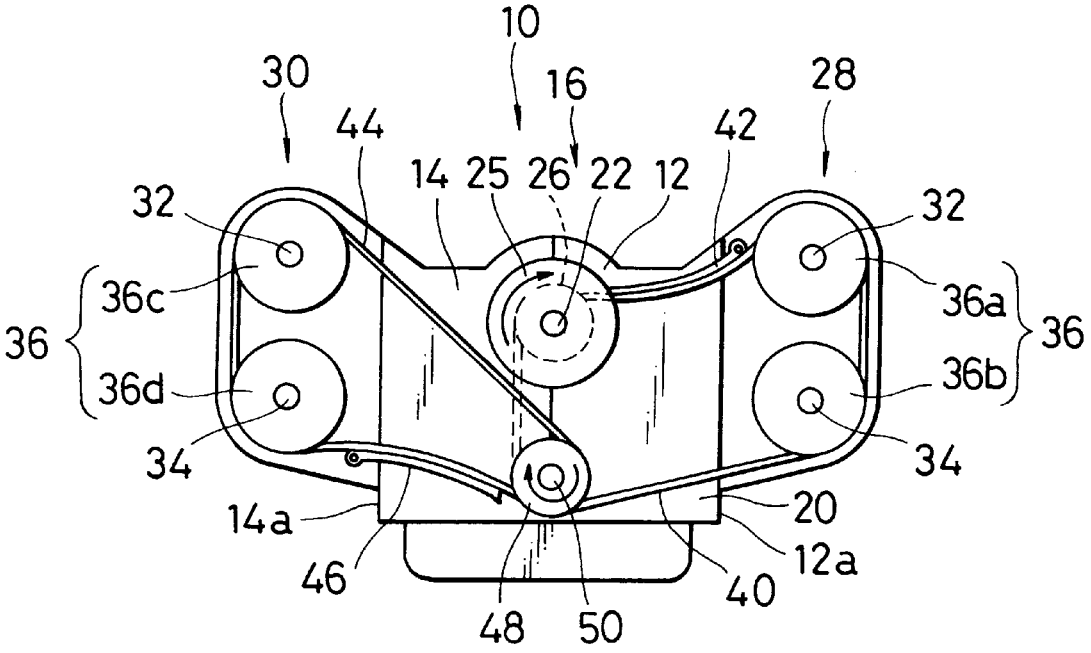
FIG. 1 is a schematic front view showing an example of a camshaft driving mechanism when applied to a horizontally opposed engine according to a first embodiment of the present invention.

As shown in FIG. 1, an internal combustion engine 10 has a left hand (LH) and right hand (RH)banks 12, 14 of a cylinder block 16 which are set 180° to each other. Cylinders 18*c*, 18*d* with in the left bank 12 and cylinders 18*a*, 18*b* are arranged being offset to each other in the longitudinal direction of the engine. Therefore, the RH bank is offset forwardly to the LH bank, thus a bank-offset being formed.

Further, a crankshaft 22 is rotatably supported by the cylinder block 16 at the center thereof. A crank pulley 25 for driving engine accessories is connected with the front end 22*a* of the crankshaft 22 and further, a crankshaft sprocket 26 for driving intake and exhaust cams is coupled with the crankshaft 22 between the cylinder block 16 and the crank pulley 25.

Further, the LH bank 12 is connected at a head 12*a* thereof with a LH cylinder head 28 and the RH bank 14 is connected at a head 14*a*, thereof with a RH cylinder head 30 through gaskets (not shown), respectively. A camshaft 32 for intake valves and a camshaft 34 for exhaust valves are rotatably supported by the LH and RH cylinder heads 28, 30 respectively. Further, in the LH cylinder head 28, camshaft sprockets 36*a*, 36*b* are connected with front ends of the camshaft 32 for intake valves and the camshaft 34 for exhaust valves, respectively. Similarly, in the RH cylinder head 30, camshaft sprockets 36*c*, 36*d* are connected with front ends of the camshaft 32 for intake valves and the camshaft 34 for exhaust valves, respectively.

Figure 2:
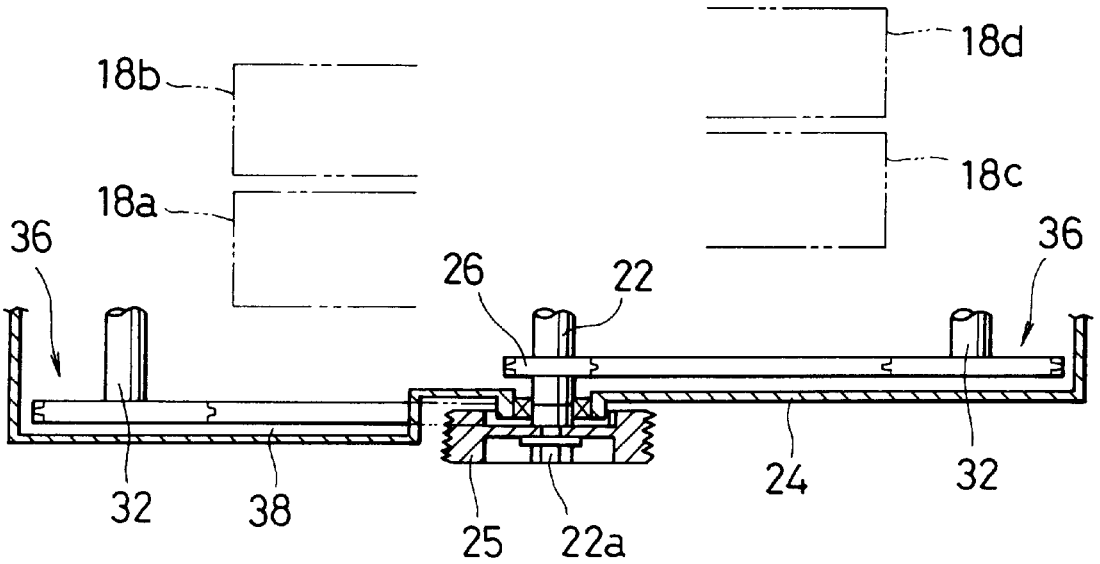
FIG. 2 is a schematic top view showing a camshaft driving mechanism when applied to a horizontally opposed engine according to a first embodiment of the present invention.

These camshaft sprockets 36 are driven by the crankshaft sprocket 26 through driving chains which will be described hereinafter. The diameters of the camshaft sprockets 36 and the crankshaft sprocket 26 are determined such that the camshaft 32 for intake valves and the camshaft 34 for exhaust valves rotate once, respectively while the crankshaft 22 rotates twice. Further, at the front end 20 of the cylinder block, as illustrated in FIG. 2, a chain cover 24 is connected with the LH and RH cylinder head 28, 30 so as to cover the whole of the camshaft driving mechanism and to form a sprocket chamber 38 separated from outside.

There is provided with a first driving chain 40 interlocking the crankshaft sprocket 26 with the camshaft sprockets 36*a*, 36*b* of the LH cylinder head 28 and an idler gear 48 which will be described hereinafter, respectively. Also, there is provided with a first tensioner 42 for applying a given amount of tension to the first driving chain 40 on the slack side thereof.

Further, there is provided with a second driving chain 44 interlocking the idler gear 48 with the camshaft sprockets 36*c*, 36*d* of the RH cylinder head 30. Further, on the slack side of the second driving chain 44, there is provided with a second tensioner 46 for applying a given amount of tension to the first driving chain 40.

The idler gear 48 by which the present invention is characterized is rotatably supported by an idler shaft 50 provided on a lower side of the crankshaft 22. In this embodiment, the idler gear 48 has the same diameter as the crankshaft sprocket 26 so that the idler gear 48 rotates once while the crankshaft sprocket 26 makes one rotation. The diameter of the idler gear 48 is not necessarily the same as that of the crankshaft sprocket 26.

Figure 3A:
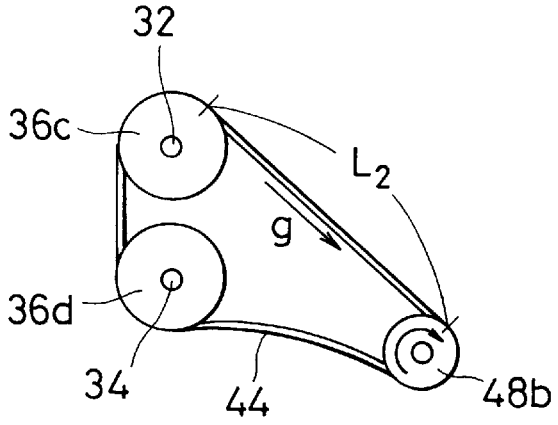
FIG. 3*a* is a schematic partial view showing an example of the arrangement of a second driving chain in the camshaft driving mechanism according to a first embodiment of the present invention.
Figure 3B:
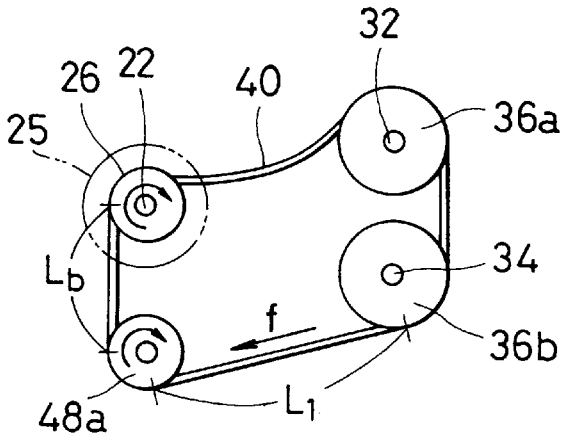
FIG. 3*b* is a schematic partial view showing an example of the arrangement of a first driving chain in the camshaft driving mechanism according to a first embodiment of the present invention.

Further, in this embodiment, the idler gear 48 is composed of twin gears coaxially connected with each other and having the same diameter, however both diameters are not necessarily identical. According to the example shown in this embodiment, the first driving chain 40 is wound around the first gear 48*a* provided close to the cylinder block 16 and the second driving chain 44 is wound around the second gear 48*b* provided at the front of the first gear 48*a*, as shown in FIGS. 3*a* and 3*b*.

The idler gear 48 is provided roughly right down the crankshaft 22 and it is located at the position where a span distance $L_1$ on the tight side of the first driving chain 40 between the camshaft sprocket 36*b* of the LH cylinder head 28 and the first gear 48*a* of the idler gear 48 becomes approximately equal to a span distance $L_2$ on the tight side of the second driving chain 44 between the camshaft sprocket 36*c* for intake valves in the RH cylinder head 30 and the second gear 48*b* of the idler gear 48.

Therefore, a LH chain span distance $L_{le}$ ($=L_1+L_b$), i.e., a sum of the span distance $L_1$ and a chain span distance $L_b$ from the first gear 48*a* to the crankshaft sprocket 26, is almost equal to a RH chain span distance $L_{ri}$ ($=L_2+L_b$), a sum of the span distance $L_2$ and $L_b$ from the first gear 48*a* to the crankshaft sprocket 26 ($L_{ri} \cong L_{ie}$)

An operation and an engine 10 thus constituted will be described.

As shown in FIGS. 3*b*, by means of the clockwise rotation of the crankshaft 22, the first driving chain 40 moves in the direction f so as to rotate the first gear 48*a* and the camshaft sprockets 36*a*, 36*b*. By this operation, the camshaft 32 for intake valves and the camshaft 34 for exhaust valves of the LH cylinder head 28 are rotated respectively so that the intake and exhaust valves (not shown) provided in the cylinders 18*c*, 18*d* of the LH cylinder head 28 are opened and closed at a specified timing.

Further, as shown in FIG. 3*a*, by the rotation of the second gear 48*b* connected with the first gear 48*a*, the second driving chain 44 moves in the direction g. Therefore, the camshaft sprockets 36*c* and 36*d* are rotated so as to drive the camshafts 32, 34 for opening and closing the intake and exhaust valves (not shown) of the RH cylinder head at a specified timing.

When the first chain 40 and the second chain 44 are elongated due to their own elasticity, thermal expansion, wearing and the like, certain amounts of angular deviation from specified initial values occur at respective rotation angles of the camshaft sprockets 36*a*, 36*b*, 36*c* and 36*d*. However, since it is considered that the elongation rate per unit length of the driving chain is constant, the total elongation of the first driving chain 40 is identical to that of the second driving chain 44 and consequently the amount of angular deviation of the camshafts makes no difference between the LH and RH banks 12, 14. Therefore, the elongation of the driving chains does not effect on the deviation of cam timing between the LH and RH banks.

Further, the camshaft driving mechanism according to the present invention is arranged such that the second driving chain 44 directs towards the idler gear 48 provided on the lower side of the crankshaft 16 without directing to the crankshaft 22, so this arrangement produces a wide space over the camshaft driving mechanism on the RH cylinder block side, whereby engine accessories such as an alternator (not shown) can be accommodated using that space.

Further, as shown in FIG. 2, since the second driving chain 44 is not wound around the crankshaft, the crank pulley 25 can be coupled with the crankshaft 22 adjacent to the first driving chain 4 0 without being interfered with the second driving chain 44 and therefore the total length of the engine can be reduced that much. Further, since the first driving chain can be accommodated in the bank-offset space on the LH bank, further reduction of the engine length is possible.

Figure 4:
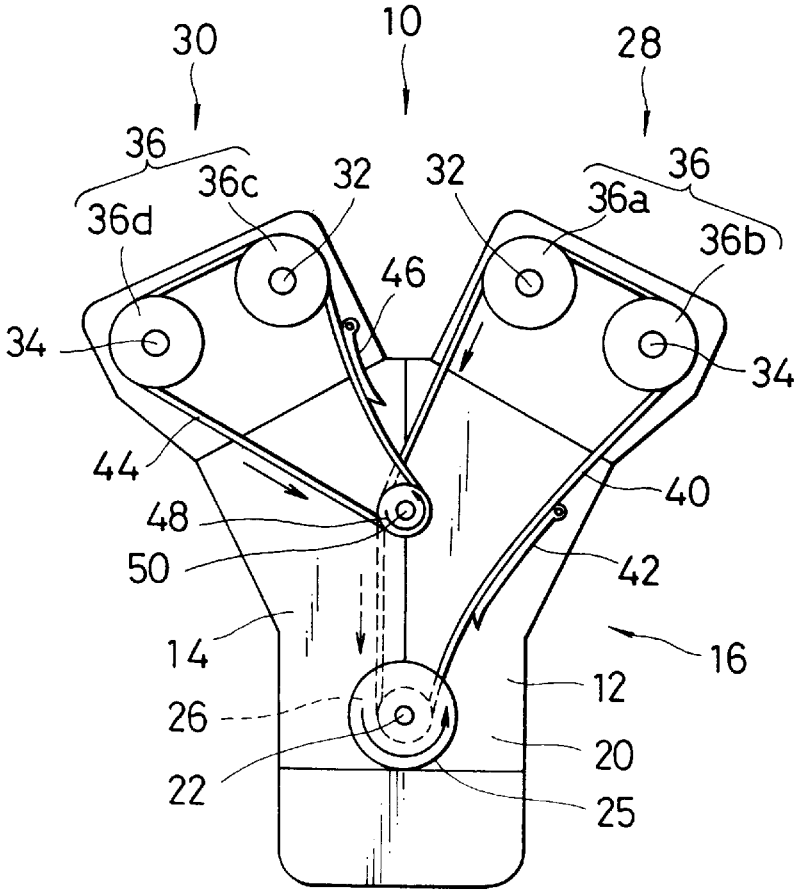
FIG. 4 is a schematic front view showing a camshaft driving mechanism when applied to a V-type engine according to a second embodiment of the present invention.
Figure 5:
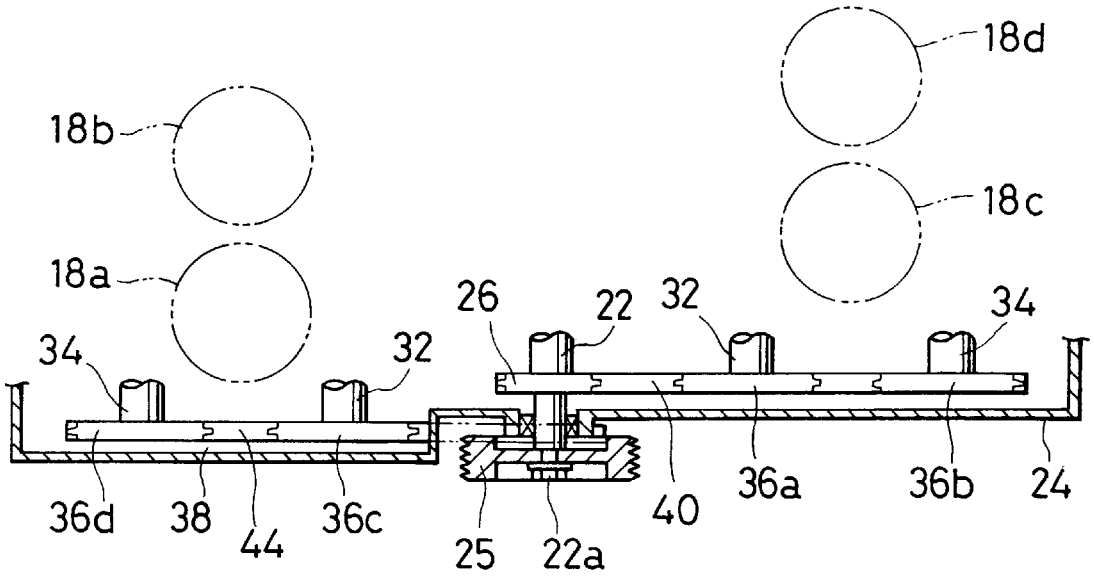
FIG. 5 is a partially sectional view showing a camshaft driving mechanism shown in FIG. 4.
Figure 6A:
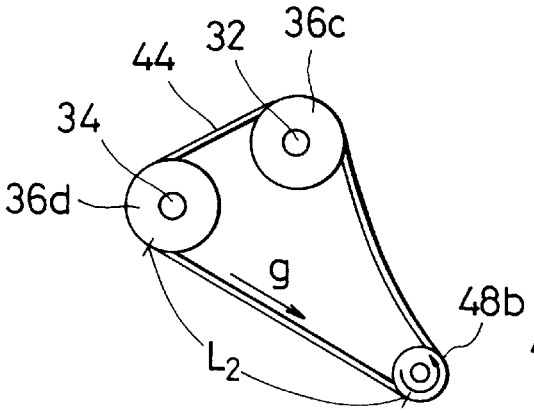
FIG. 6*a* and 6*b* schematic partial views, respectively showing an example of the arrangement of a first and second driving chains in the camshaft driving mechanism according to a second embodiment of the present invention.
Figure 6B:
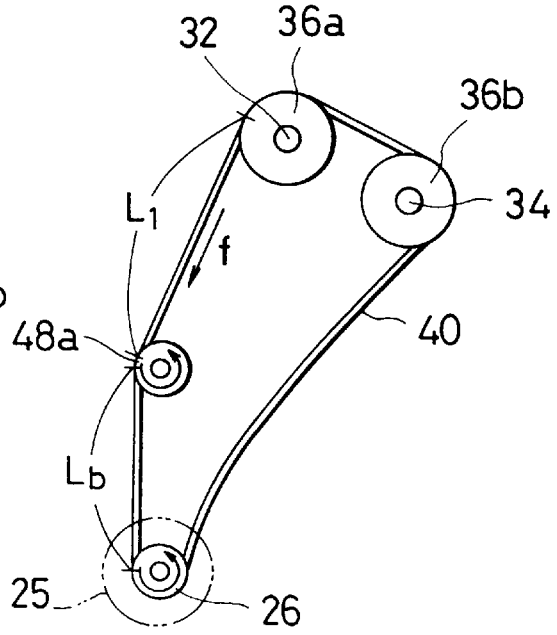
Figure 7:
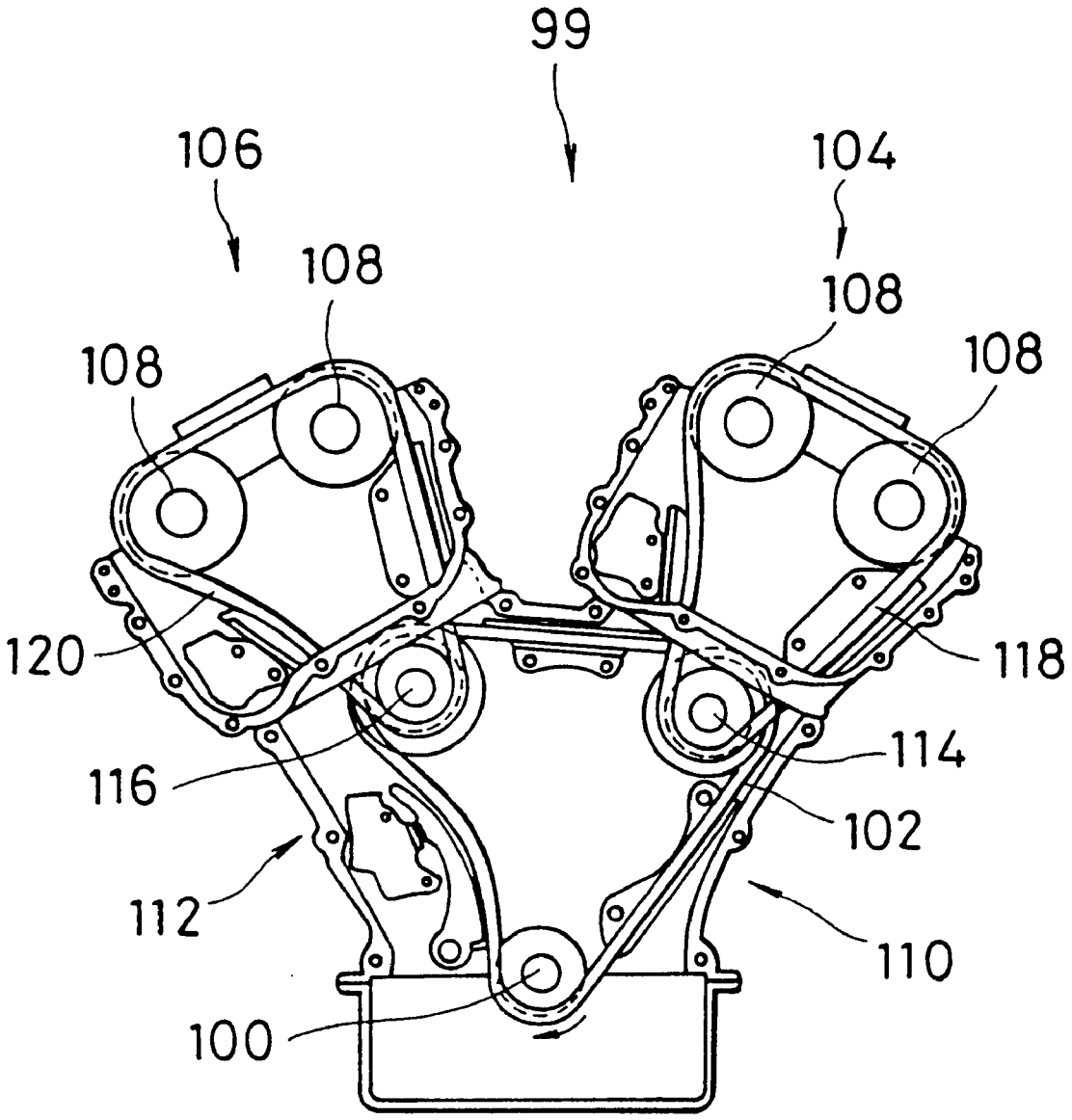
FIG. 7 PRIOR ART
FIG. 7 is a schematic front view showing an example of a camshaft driving mechanism according to a prior art.
Figure 8:
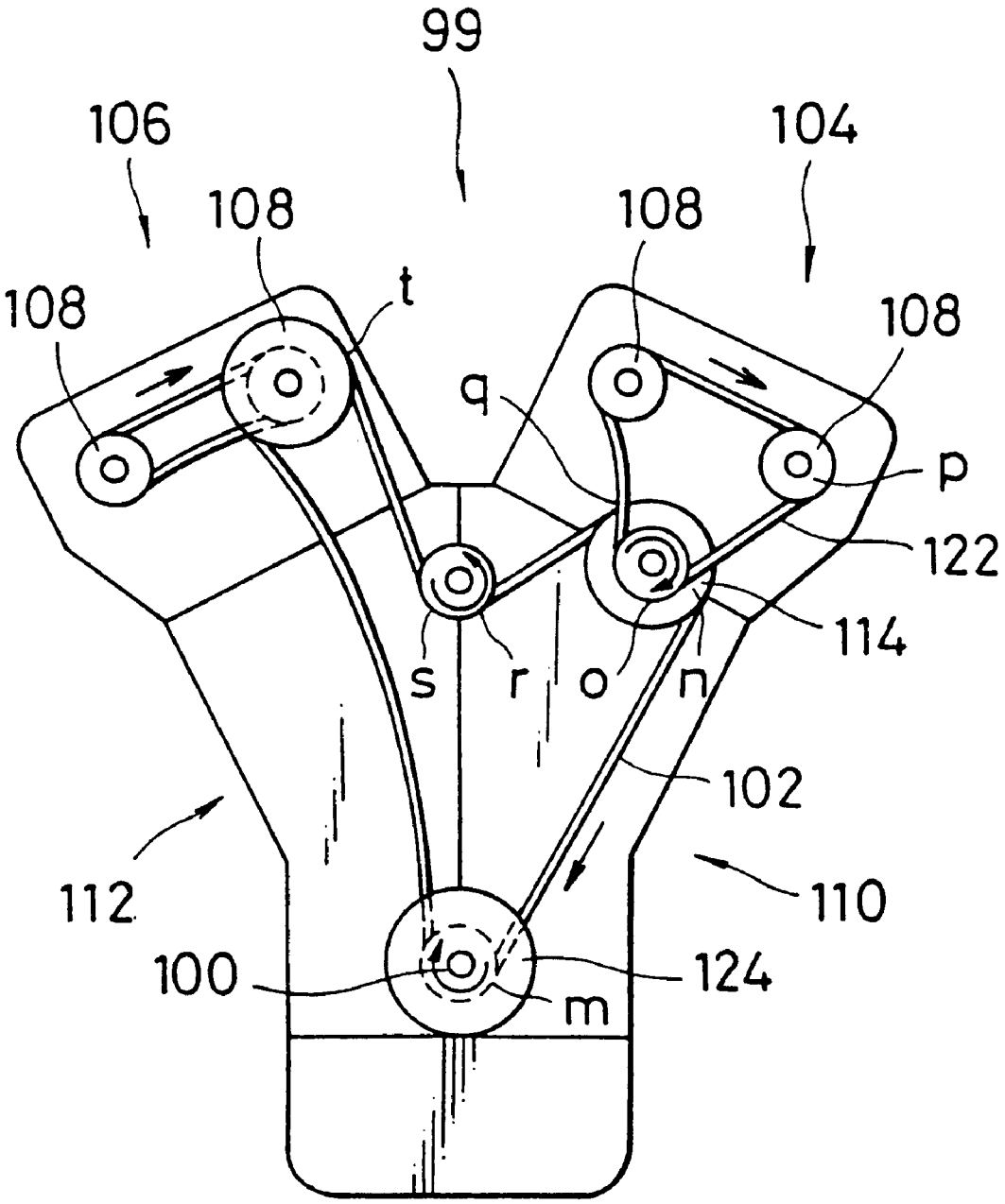
FIG. 8 PRIOR ART
FIG. 8 is a schematic front view showing an example of a camshaft driving mechanism according to another prior art.
Figure 9:
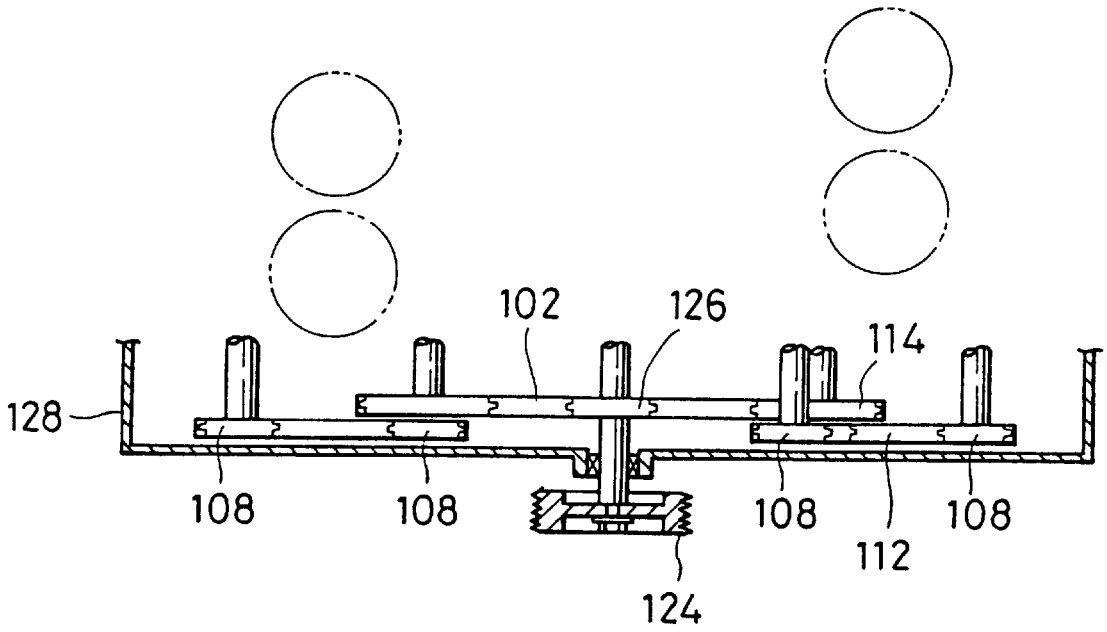
FIG. 9 PRIOR ART
FIG. 9 is a partially sectional view showing a camshaft driving mechanism shown in FIG. 8.

FIGS. 4 and 5 shows an example of a second embodiment of the present invention applied to a V-type engine. In this embodiment, the idler gear 48 is disposed above the crankshaft 22 where the span length on the tight side of the first driving chain is equal to that on the tight side of the second driving chain. The first tensioner 42 is provided so as to push the slack side of the first driving chain 40 towards the center of the cylinder block 16, thereby a large space being secured on the left and right sides of the cylinder block 16 so as to facilitate the arrangement of engine accessories (not shown).

Further, as can be understood from FIG. 5, since the crankshaft 22 is interlocked with the first driving chain 40 only, the crank pulley 25 can be provided adjacent to the first driving chain 40, so the longitudinal space can be saved by that much.

In the aforementioned first and second embodiments of the present invention, the camshaft driving mechanism has been described taking examples composed of driving chains and sprockets. The combination of chains and sprockets is advantageous in saving the lengthwise space of an engine but if it is allowed to compromise this lengthwise space problem, it is possible to employ the combination of toothed belts and pulleys instead of chains and sprockets.

Further, examples of engines according to the first and second embodiments are DOHC engines having two camshafts in one cylinder head, however applicable engines may be SOHC engines having one camshaft.

In summary, according to the camshaft driving mechanism presented in the present invention, because of the idler shaft provided at the position where the span length on the tight side of the first driving chain is equal or close to the span length on the tight side of the second driving chain, the angular deviation of camshafts for driving intake and exhaust valves can be equalized between the left and right banks of the cylinder block even when driving chains are elongated. Further, since the second driving chain is driven by the idler shaft, not by the crankshaft, a lengthwise width of the chain cover can be saved at the front of the cylinder block.

While the presently preferred embodiments of the present invention have been shown and described, it is to be understood that these disclosures are for the purpose of illustration and that various changes and modifications may be made without departing from the scope of the invention as set forth in the appended claim.

What is claimed is:

1. A camshaft driving mechanism for an overhead cam type internal combustion engine having a crankshaft provided in a cylinder block, said block having a first bank of a plurality of cylinders arranged in line with said crankshaft on a first side portion of said cylinder block, and a second bank of a plurality of cylinders arranged in line with said crankshaft on a second side portion of said cylinder block, a first cylinder head mounted on an outside portion of said first bank for including an intake valve camshaft and an exhaust valve camshaft, a second cylinder lead mounted on an outside portion of said second bank for including an intake valve camshaft and an exhaust valve camshaft, a first sprocket coaxially connected to a first end of said intake valve camshaft of said first bank, a second sprocket coaxially connected to a first end of said exhaust valve camshaft of said first bank, a third sprocket coaxially connected to a first end r said intake valve camshaft of said second bank, a fourth sprocket coaxially connected to a first end of said exhaust valve camshaft of said second bank, a crank pulley coaxially connected to a first end of said crankshaft, and a crankshaft sprocket coaxially connected to said crankshaft, said camshaft driving mechanism comprising:

an idler shaft protruded from a first surface of said cylinder block;

a first idler gear and a second idler gear coaxially and rotatably supported on a first end of said idler shaft;

a first chain wound on said crankshaft sprocket, said first sprocket, said second sprocket, and said first idler gear for rotating said intake valve camshaft and said exhaust valve camshaft of said first bank; and a second chain wound on said second idler gear, said third sprocket, and said fourth sprocket for rotating said intake valve cain shaft and said exhaust valve camshaft of said second bank so as to decrease elongation of said first and second chains by minimizing both lengths thereof and thereby enabling easy adjustment of timings of both intake and exhaust valve camshafts with that of said crankshaft.

2. The camshaft driving mechanism according to claim 1, wherein:

said idler shaft is located at a position where a first summation of a first distance between said first idler gear and said second sprocket and a second distance between said crankshaft sprocket and said first idler gear of said first bank is approximately the same as a second summation of said second distance and a third distance between said second idler gear and said third sprocket of said second bank.

3. The camshaft driving mechanism according to claim 2, wherein:

said first distance is approximately equal to said third distance.

4. The camshaft driving mechanism according to claim 1, wherein:

said crank pulley is coaxially and mechanically connected to an end of said crankshaft; and said first chain occupies a part of a bank-offset space formed by a staggered installation of said first bank and said second bank.

5. A camshaft driving mechanism for an overhead cam type internal combustion engine having a crankshaft provided in a cylinder block, said block having a first bank of a plurality of cylinders arranged in line with said crankshaft on a first side portion of said cylinder block, and a second bank of a plurality of cylinders arranged in line with said crankshaft on a second side portion of said cylinder block, a first cylinder head mounted on an outside portion of said first bank for including an intake valve camshaft and an exhaust valve camshaft, a second cylinder head mounted on an outside portion of said second bank for including an intake valve camshaft and an exhaust valve camshaft, a first sprocket coaxially connected to a first end of said intake valve camshaft of said first bank, a second sprocket coaxially connected to a first end of said exhaust valve camshaft of said first bank, a third sprocket coaxially connected to a first end of said intake valve camshaft of said second bank, a fourth sprocket coaxially connected to a first end of said exhaust valve camshaft of said second bank, a crank pulley coaxially connected to a first end of said crankshaft, and a crankshaft sprocket coaxially connected to said crankshaft, said camshaft driving mechanism consisting essentially of:

an idler shaft protruded from a first surface of said cylinder block;

a first idler gear and a second idler gear coaxially and rotatably supported on a first end of said idler shaft;

a first chain wound on said crankshaft sprocket, said first sprocket, said second sprocket, and said first idler gear for rotating said intake valve camshaft and said exhaust valve camshaft of said first bank; and a second chain wound on said second idler gear, said third sprocket, and said fourth sprocket for rotating said intake valve camshaft and said exhaust valve camshaft of said second bank so as to decrease elongation of said first and second chains by minimizing both lengths thereof and thereby enabling easy adjustment of timings of both intake and exhaust valve camshafts with that of said crankshaft.

6. A camshaft driving mechanism for an overhead cam type internal combustion engine having a crankshaft provided in a cylinder block, said block having a first bank of a plurality of cylinders arranged in line with said crankshaft on a first side portion of said cylinder block, and a second bank of a plurality of cylinders arranged in line with said crankshaft on a second side portion of said cylinder block, a first cylinder head mounted on an outside portion of said first bank for including an intake valve camshaft and an exhaust valve camshaft, a second cylinder head mounted on an outside portion of said second bank for including an intake valve camshaft and an exhaust valve camshaft, a first sprocket coaxially connected to a first end of said intake valve camshaft of said first bank, a second sprocket coaxially connected to a first end of said exhaust valve camshaft of said first bank, a third sprocket coaxially connected to a first end of said intake valve camshaft of said second bank, a fourth sprocket coaxially connected to a first end of said exhaust valve camshaft of said second bank, a crank pulley coaxially connected to a first end of said crankshaft, and a crankshaft sprocket coaxially connected to said crankshaft, said camshaft driving mechanism comprising:

an idler shaft protruded from a first surface of said cylinder block;

first idler gear and a second idler gear coaxially and rotatably supported on a first end of said idler shaft;

a first belt wound on said crankshaft sprocket, said first sprocket, said second sprocket, and said first idler gear for rotating said intake valve camshaft and said exhaust valve camshaft of said first bank; and a second belt wound on said second idler gears said third sprocket, and said fourth sprocket for rotating said intake valve camshaft and said exhaust valve camshaft of said second bank so as to decrease elongation of said first and second belts by minimizing both lengths thereof and thereby enabling easy adjustment of timings of both intake and exhaust valve camshafts with that of said crankshaft.

7. The camshaft driving mechanism according to claim 6, wherein:

said idler shaft is located at a position where a first summation of a first distance between said first idler gear and said second sprocket and a second distance between said crankshaft sprocket and said first idler gear of said first bank is approximately the same as a second summation of said second distance and a third distance between said second idler gear and said third sprocket of said second bank.

* * * * *